US008261510B2

(12) United States Patent
Johnson et al.

(10) Patent No.: US 8,261,510 B2
(45) Date of Patent: Sep. 11, 2012

(54) METHOD OF BUILDING ELEVATED WATER STORAGE TANKS

(75) Inventors: Mark Richard Johnson, Birmingham, AL (US); Kevin A. Binder, Ankeny, IA (US); Jerral H. Turner, Montevallo, AL (US)

(73) Assignee: Chicago Bridge & Iron Company, Plainfield, IL (US)

( * ) Notice: Subject to any disclaimer, the term of this patent is extended or adjusted under 35 U.S.C. 154(b) by 884 days.

(21) Appl. No.: 12/112,574

(22) Filed: Apr. 30, 2008

(65) Prior Publication Data

US 2009/0272049 A1 Nov. 5, 2009

(51) Int. Cl.
*E04B 1/00* (2006.01)
*E04B 7/00* (2006.01)

(52) U.S. Cl. ..... 52/745.01; 52/82; 52/194; 220/567

(58) Field of Classification Search ..... 52/745.01, 52/40, 80.1, 81.6, 82, 168, 192, 194, 741.12, 52/745.04, 745.19, 745.2; 220/567; 264/31–34, 264/333, 299
See application file for complete search history.

(56) References Cited

U.S. PATENT DOCUMENTS 2,235,937 A * 3/1941 Linberg ..... 264/36.15
2,331,657 A * 10/1943 Crom ..... 264/32
3,073,018 A * 1/1963 Gauthron ..... 29/421.1
3,184,892 A * 5/1965 Silberkuhl et al. ..... 52/223.8
3,292,315 A * 12/1966 Silberkuhl et al. ..... 52/81.6
3,296,754 A * 1/1967 Silberkuhl et al. ..... 52/81.6
3,300,916 A * 1/1967 Pritzker ..... 52/81.6
3,511,003 A * 5/1970 Alleaume ..... 52/198
4,154,029 A * 5/1979 Kinkel et al. ..... 220/582
4,312,167 A * 1/1982 Cazaly et al. ..... 52/745.01
4,327,531 A * 5/1982 Cazaly et al. ..... 52/73
4,442,639 A * 4/1984 Lindsey et al. ..... 52/73
(Continued)

FOREIGN PATENT DOCUMENTS

CA 1245877 A * 12/1988
(Continued)

*Primary Examiner* — Robert Canfield
*Assistant Examiner* — Charissa Ahmad
(74) *Attorney, Agent, or Firm* — Osha Liang LLP

(57) ABSTRACT

The disclosed liquid storage tank has a concrete tower section. A steel tank shell above the tower section encompasses a tank volume that has a capacity of at least 100,000 U.S. gallons. A concrete ringbeam at the top of the tower section surrounds an internal area between the ringbeam and an access tube that extends from within the tank volume into an interior of the tower section. The ringbeam has an integral upper wall above a ring-shaped, upwardly-facing supporting face that is at least about 4" inches wide and resists downward forces. A series of laterally adjacent concrete dome segments creates a dome that has a vaulted upper surface and essentially covers the internal area. Each of the dome segments has an outer end that sits on the supporting face of the ringbeam, and an inner end that is positioned above the outer end. Lateral sides on each segment define a segment angle, and the sum of the segment angles of the adjacent segments is less than 360 degrees. Fill sections extend between adjacent dome segments. A pourback creates a continuous surface from the top of the upper wall on the ringbeam to a raised portion of the dome segments. A steel liner covers the dome. The liner has a vaulted upper surface and is connected to the tank shell. In building the tank, precast dome segments can be temporarily supported, with the support being removed after all the segments are placed.

7 Claims, 7 Drawing Sheets

U.S. PATENT DOCUMENTS

| | | | | | |
|---|---|---|---|---|---|
| 4,458,458 | A | * | 7/1984 | Orii | 52/173.1 |
| 4,486,988 | A | * | 12/1984 | Myers | 52/192 |
| 4,486,989 | A | * | 12/1984 | DesRochers et al. | 52/194 |
| 4,513,547 | A | * | 4/1985 | Cliff et al. | 52/194 |
| 4,541,210 | A | * | 9/1985 | Cook | 52/82 |
| 4,578,921 | A | * | 4/1986 | Cazaly et al. | 52/745.01 |
| 4,660,336 | A | * | 4/1987 | Cazaly et al. | 52/192 |
| 5,029,426 | A | * | 7/1991 | Larson et al. | 52/745.01 |
| 5,241,797 | A | * | 9/1993 | Cliff | 52/192 |
| 7,008,163 | B2 | * | 3/2006 | Russell | 414/306 |
| 7,487,619 | B2 | * | 2/2009 | Glenn | 52/194 |

FOREIGN PATENT DOCUMENTS

| | | | | |
|---|---|---|---|---|
| EP | 326892 | A1 | * | 8/1989 |
| JP | 05033523 | A | * | 2/1993 |
| JP | 06010532 | A | * | 1/1994 |
| JP | 06108697 | A | * | 4/1994 |
| JP | 09310442 | A | * | 12/1997 |

* cited by examiner

METHOD OF BUILDING ELEVATED WATER STORAGE TANKS

CROSS-REFERENCE TO RELATED APPLICATIONS

Not applicable.

BACKGROUND OF THE INVENTION

A new innovation has been developed relating generally to elevated water storage tanks such as those used by municipalities. The capacity of such water storage tanks can range from about one hundred thousand U.S. gallons to several million gallons, and conventionally such tanks are built entirely of steel, or with a steel reservoir on top of a concrete pedestal.

In structures that use a concrete pedestal ("composite elevated tanks"), high risk work tasks and expensive formwork have historically been required to build a concrete dome on top of the tower, to support the water reservoir.

BRIEF SUMMARY

The applicants have developed new method of building a concrete dome in a composite elevated tank. Like most such tanks, the new tank has a tank shell positioned above a tower section, and the top of the tower section includes a ringbeam that supports the dome and the tank shell.

Historically, the structural dome on a composite elevated tank is constructed using a cast-in-place method of construction. A series of pie-shaped forms is erected on top of the tower section (typically from fifty to two hundred feet above the ground) to form a spherical segment. Reinforcing steel is placed on the formwork, and then concrete is poured using either a pump or a concrete bucket or trolley. The top of the concrete is then screeded with a circular screed to create a spherical surface. Once the concrete is cured, the formwork on the underside of the dome is stripped and lowered to the ground using a derrick or crane.

A novel method can be used to build the new tank. In that method, wedge-shaped concrete floor segments are cast near grade (or even off-site) and individually lifted to the ring beam. The segments can be curved in either length or breadth (or both) but, in some circumstances, might also be linear in either or both dimensions. The segments are placed side-by-side over the internal opening in the ringbeam, with the outer end of each segment on a supporting face on the ring beam. The inner end of the segment is positioned higher than the than the outer end and, when needed, can be supported by a temporary support. When they are all placed, the floor segments create the shape of the dome. The dome can be linear in both horizontal cross-section and in profile (like a pyramid), curved in profile but not in horizontal cross-section (like an umbrella), curved in horizontal cross-section but not in profile (like a cone), or curved in both horizontal cross-section and in profile (like a spherical section).

This method eliminates the need for preparing and raising complicated and expensive formwork to build the dome. In addition, less labor is required at the top of the tower, reducing the risk of injury. The concrete segments can be cast directly against steel liner plates, providing further advantages of an integral or composite segment.

BRIEF DESCRIPTION OF THE DRAWINGS

The invention may be better understood by referring to the accompanying drawings, in which.

DETAILED DESCRIPTION

Figure 1:
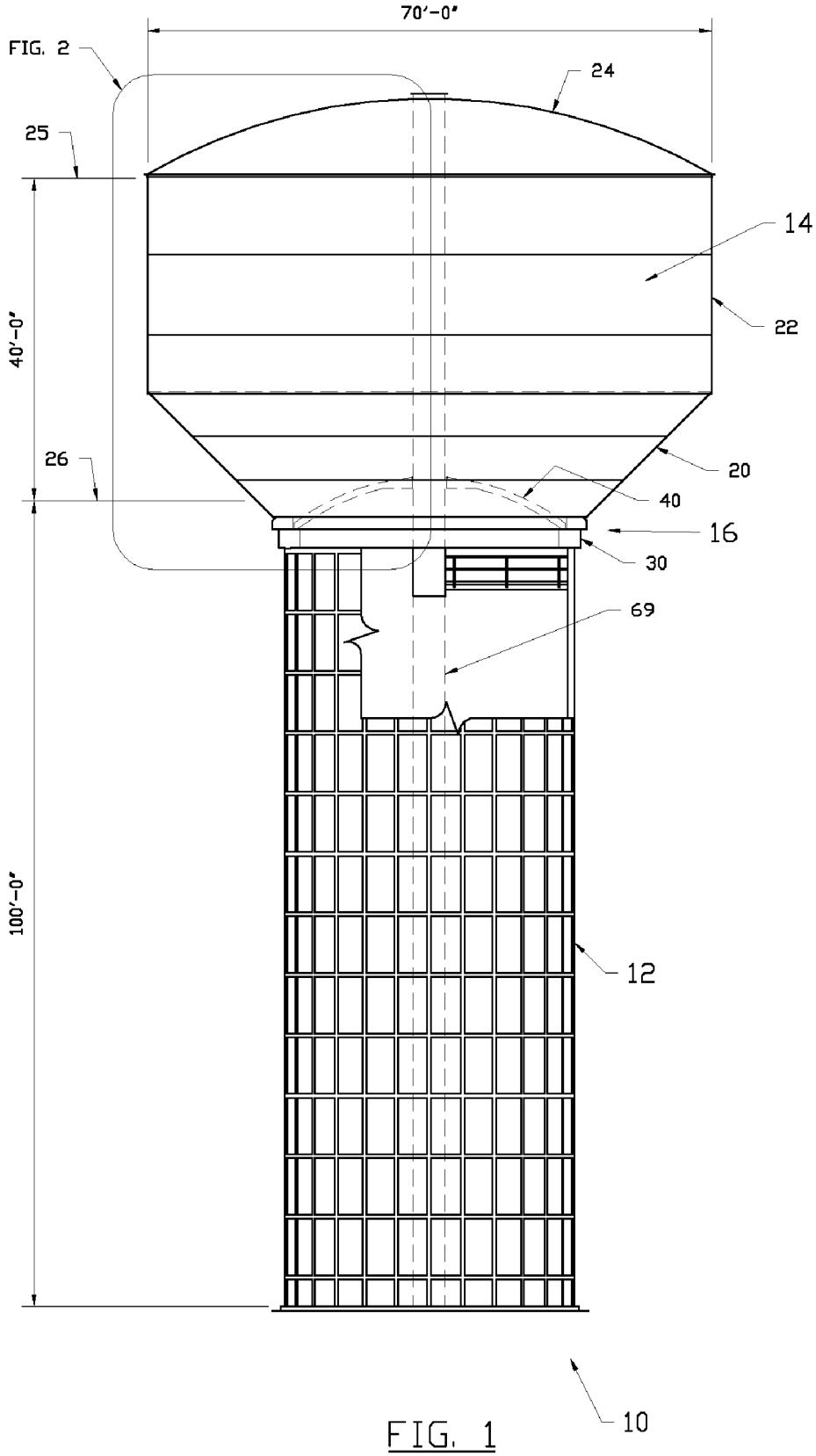
FIG. 1 is a side view of one embodiment of a composite elevated tank that uses the invention.

The figures illustrate one embodiment of a tank that uses the invention. The tank 10 illustrated in FIG. 1 has a tower section 12, tank shell 14, and an intermediate section 16. Each of these parts will be described in more detail below. The description of the parts of the tank will be followed by a discussion of the tank's construction.

The Tower Section

The illustrated tower section 12 is approximately 100 feet tall and made of 13 cast-in place concrete rings. The tower section is approximately 36 feet in diameter, and has cylindrical walls that are approximately 10 inches thick. The size and configuration of the tower section can be varied to meet the particular needs of a job.

The Outer Tank Shell

The tank shell 14 is positioned above the tower section 12. The tank shell that is illustrated here is made of steel and has a frustoconical bottom section 20, a cylindrical section 22 above it, and a domed roof 24. All these sections of the tank shell are made primarily of steel. The cylindrical section is made of multiple courses of steel shell plates. Overall, the tank shell is approximately 70 feet in diameter and 40 feet tall from a top capacity level 25 to a bottom capacity level 26, providing a capacity of approximately one million U.S. gallons. In other situations, the arrangement or dimensions of the tank shell could vary, and could provide a capacity ranging from one hundred thousand U.S. gallons to several million gallons.

The Intermediate Section

Figure 2:
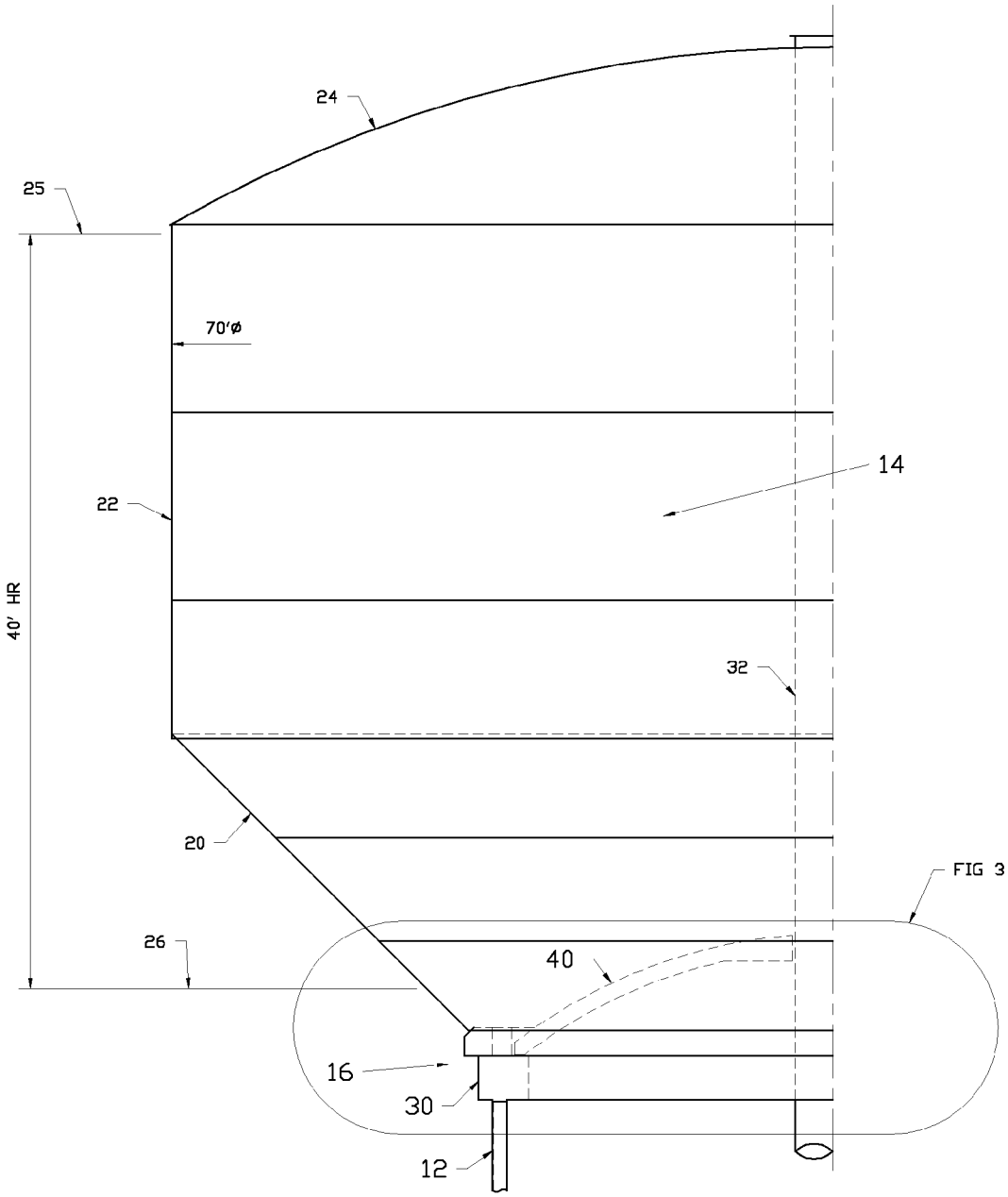
FIG. 2 is an enlarged fragmentary cross-sectional view of the top of the tank seen in FIG. 1.
Figure 3:
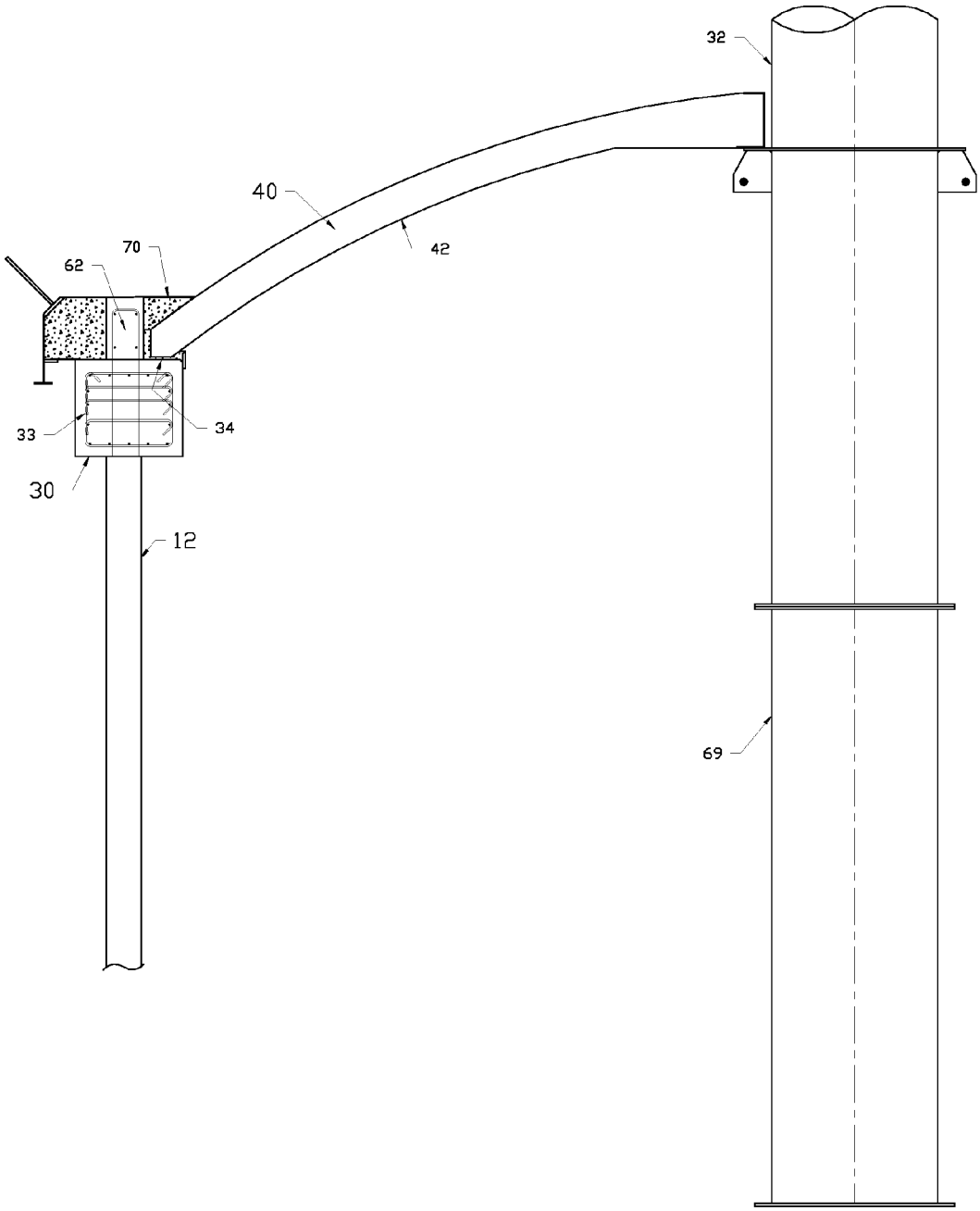
FIG. 3 is an enlarged cross-sectional view of the ringbeam, dome, and access tube of the tank.

The intermediate section 16 of the illustrated tank 10 includes a ringbeam 30, best seen in FIGS. 2 and 3, at the top of the tower section 12. The ringbeam surrounds an internal area that, in this example, accommodates a four-foot diameter access tube 32 (FIG. 3) that extends from within the tank volume into an interior of the tower section. The illustrated ringbeam is made of concrete and has internal steel reinforcement 33, as shown in FIG. 3.

The ringbeam is configured with a ring-shaped, upwardly-facing supporting face 34 that resists downward forces. In this example, the supporting face is a horizontal surface adjacent to the innermost upper edge of the ringbeam 30. Here, the supporting face is approximately 11 inches wide. In other situations, the supporting face could be inclined or segmented, and could be as little as 4" wide.

Figure 4:
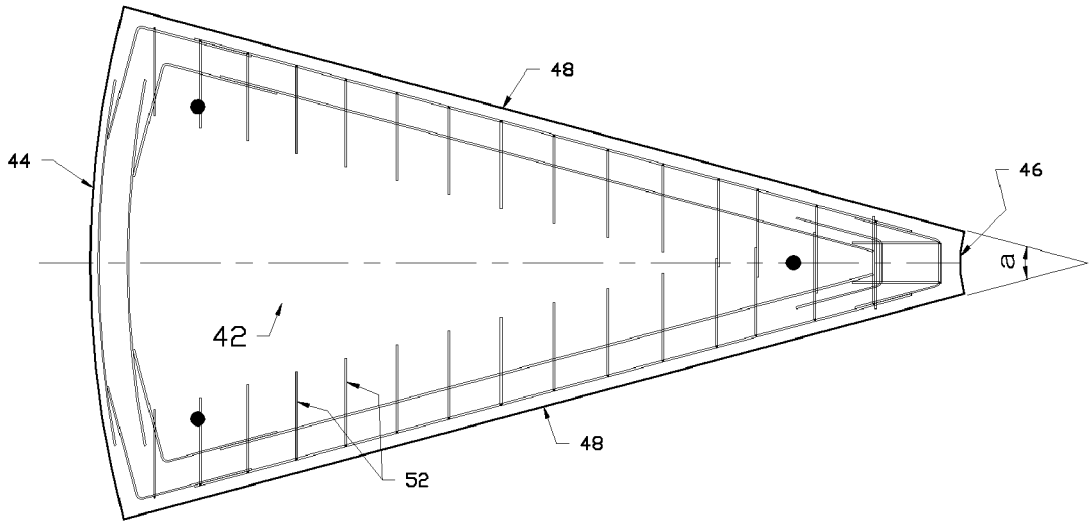
FIG. 4 is a top view of one of the panels of the dome, in a raised position.
Figure 5:
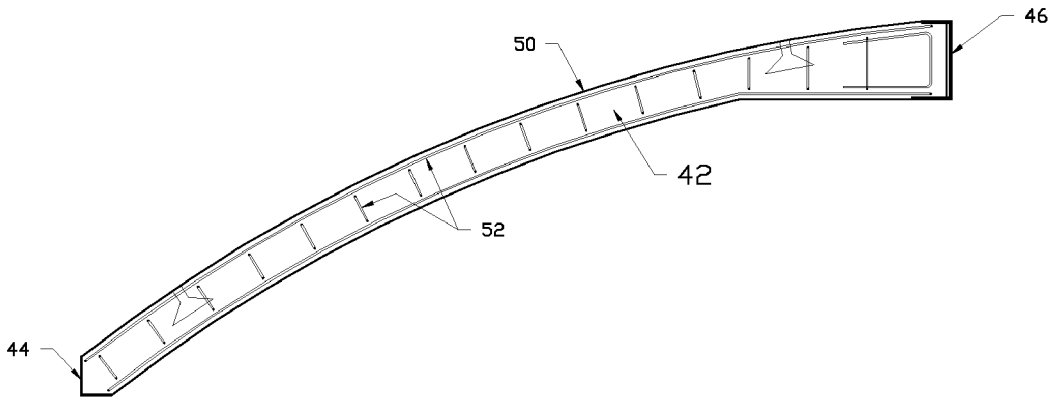
FIG. 5 is a side view of the panel seen in FIG. 4.
Figure 6:
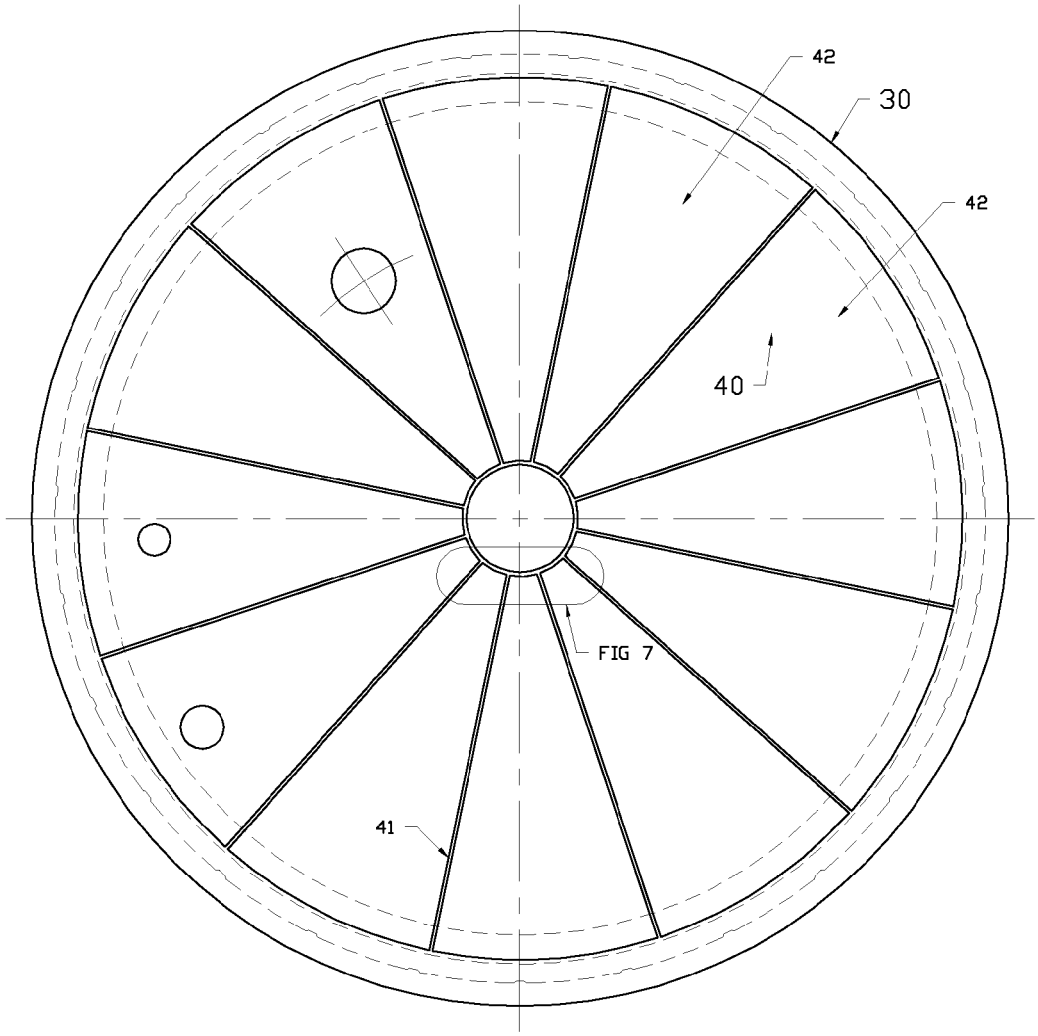
FIG. 6 is a top view of the panels in the dome.

The intermediate section 16 of the tank 10 also includes a dome 40 that sits on the supporting face 34 of the ringbeam 30. The dome is made of laterally adjacent concrete dome segments 42 that are best seen in FIGS. 4-6. When placed, these segments essentially cover the internal area within the central opening of the ringbeam. In this example, the access tube 32 passes through that internal area, so the dome has an opening to accommodate the access tube.

Each of the dome segments 42 illustrated here is made of concrete and has an outer end 44, an inner end 46, a pair of lateral sides 48, and a vaulted top surface 50. Internal steel reinforcement 52 is included in the illustrated dome segments for tensile strength. For ease of fabrication, it will generally be preferred for all or most of the segments to be the same size. The illustrated segments are approximately 1 foot wide at the inner end, approximately 8 feet wide at the outer end, and measure approximately 14 feet from the inner end to the outer end. For strength, the inner end is thicker than the outer end. The size may vary, however.

The lateral sides 48 of the segment 42 define a segment angle $\alpha$ that can be measured when the segment is laid flat, with both the inner end and the outer end resting on a horizontal surface. In the illustrated example, there are twelve dome segments and the segment angle of each segment is approximately 28°. In other situations, the segment angle and number of segments will generally be between six segments with segment angles of approximately 56° and thirty segments with segment angles of approximately 11°. In other situations, segment angles outside this range could also be useful. In all these cases, however, the sum of the segment angles of each of the dome segments used in a dome will be less than 360° when the angle is measured with the segments lying flat, and positioning the segments in a flat circular arrangement will leave wider gaps near the outer ends of the segments than near the inner ends.

When installed, the inner ends 46 of the segments 42 are raised above the outer ends 44, shortening the horizontal distance between the inner and outer ends and increasing the apparent angle, when viewed from above, between the lateral sides 48. This raising of the inner ends of the segments enables the segments to fit together, with parts of the lateral sides of each segment lying close to or directly against the lateral sides of each adjacent segment, as seen in FIG. 6. Once assembled in this way, the segments combine to provide a vaulted upper surface on the dome 40 that extends from the supporting face 34 on the ringbeam 30 to the access tube 32. With the outer ends of the segments supported against outward displacement (in this case by a 1½-foot tall, 1-foot wide reinforced concrete upper wall 62 on the ringbeam, best seen in FIG. 3), the floor can withstand construction loads. Cement grout or a comparable compression-resistant spacing material can then be used to fill the gaps between the segments. Once grouted, the dome is self-supporting and can withstand all design loads.

Figure 8:
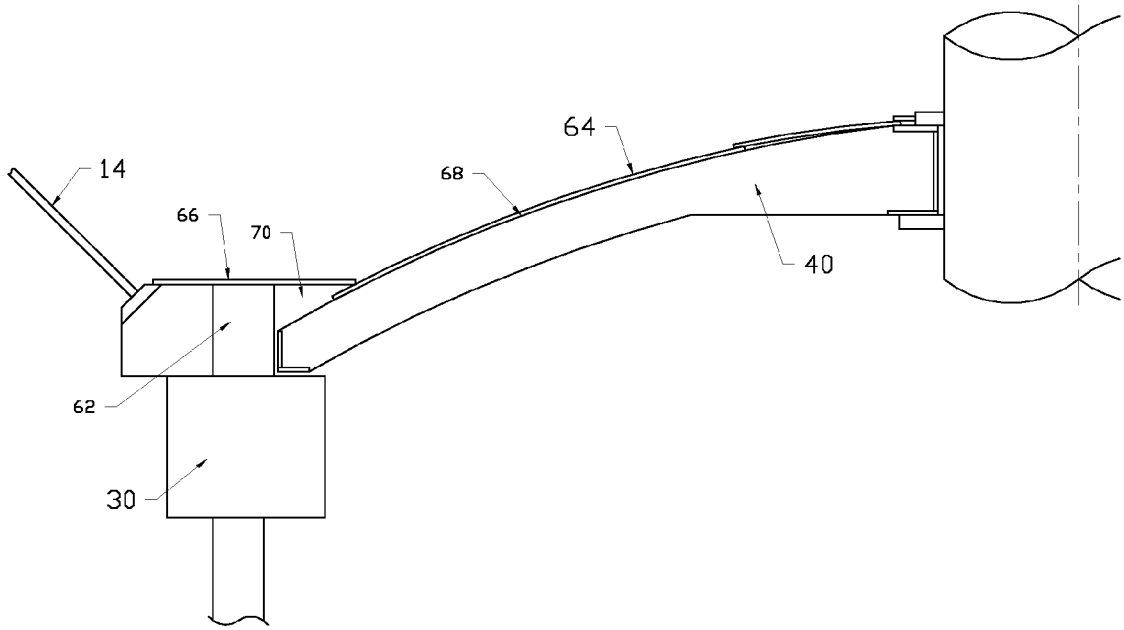
FIG. 8 is a side view of the dome, showing a tank liner in place.
Figure 9:
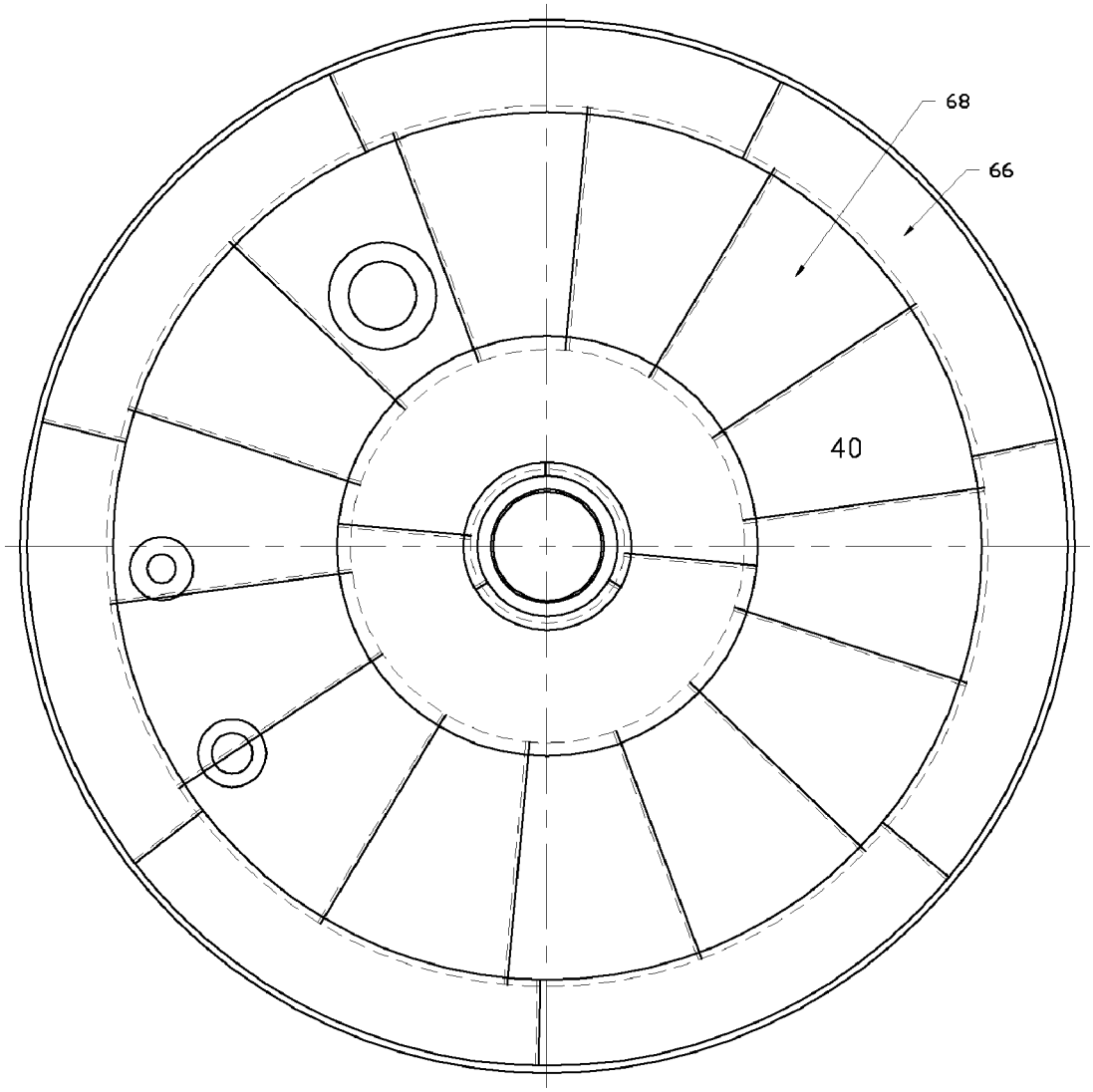
FIG. 9 is a top view of the liner.

The illustrated dome 40 is covered by a steel tank liner 64, best seen in FIGS. 8 and 9, which is welded to the tank shell. The illustrated liner includes an outer, planar section 66 and an inner, vaulted section 68.

In some circumstances, the liner 64 can be formed from liner segments that are integrally cast with the dome segments 42. Integrally forming the liner segments with the dome segments can be accomplished by casting the concrete against the liner, using embeds or studs. When the dome 40 is assembled, the liner segments on adjacent dome segments can be connected by welded sealing strips. This process provides a tight fit between the concrete dome segments and the liner, eliminates the need for erecting the liner separately, and reduces the amount of dangerous work at high elevations.

Construction of the Tower

Conventional construction techniques are well understood by those skilled in the art, and can be used in many stages of the construction of the illustrated tank 10.

After the tower section 12 is constructed, the ringbeam 30 is added to the top of the tower section.

The wedge-shaped dome segments 42 can be cast on site or fabricated off site. They are lifted to the ring beam and placed side-by-side over the internal opening in the ringbeam 30. The segments are installed with the outer ends 44 of the segments on the supporting face 34 on the ringbeam and the inner ends 46 of the segments higher than the outer end. A temporary support 69 can be used to temporarily support the inner end of the segments.

Figure 7:
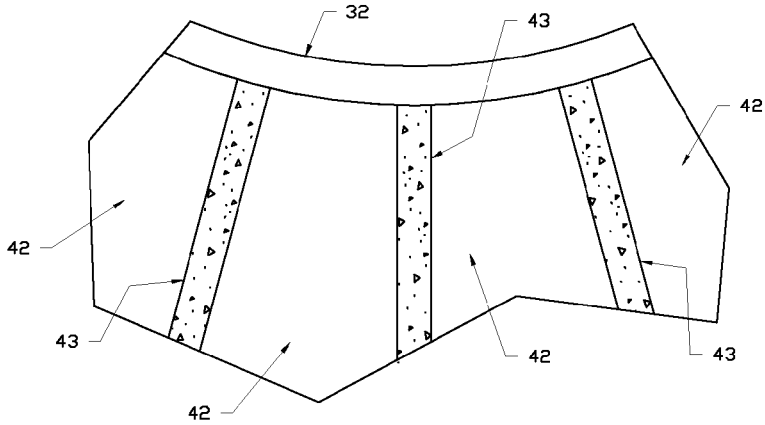
FIG. 7 is a fragmentary top view showing the edges of the panels adjacent the access tube.

After placement, the joints 41 between adjacent dome segments 42 are filled with grout 43 as shown in FIGS. 6 and 7. In this example, the sides of the adjoining segments are spaced between ¾" and 1½ inches apart. It is preferred that spacing be relatively close, to reduce concerns about the ability of the grout to withstand shrinkage and load cycling. To help withstand shear loads between the segments, it may also be useful to provide shear keys on the lateral faces of segments. Once the last segment is installed and grouted, the temporary support 69 can be removed. In some cases, it may be practical to remove it after all construction is complete.

In the illustrated example, an optional concrete pourback 70 may be added at the outer ends of the dome 40. This pourback provides a smooth transition from the top of the upper wall 62 on the ringbeam 30 to the vaulted surface of the dome, and does not require either formwork or internal reinforcement.

In this example, the steel liner 64 is then applied onto the vaulted surface of the dome 40 and the top of the pourback 70 and the upper wall 62. The liner is connected to the steel tank shell 14, forming the liquid reservoir.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A method of building an elevated liquid storage tank with a capacity of at least 100,000 U.S. gallons of a liquid comprising:

erecting a tower section;

erecting a reinforced ringbeam at the top of the tower section, which surrounds an internal opening;

lifting wedge-shaped dome segments, each having an inner end and an outer end, and placing them side-by-side over the internal opening, with the outer end of each segment on a supporting face on the ringbeam and the inner end of the segment higher than the outer end;

erecting a tank shell above the tower section, forming a tank volume that is encompassed by the tank shell and the dome segments, wherein the reinforced ringbeam withstands the downward force of the liquid.

2. A method as recited in claim 1, in which a grout-type material is provided between the dome segments.

3. A method as recited in claim 1, in which:

the dome segments are placed with an inner end of the segment supported by a temporary support; and the temporary support is removed after the dome segments are placed.

4. A method as recited in claim 1, in which:

the ringbeam has an integral upper wall that rises above the supporting face.

5. A method as recited in claim 1, in which:

the ringbeam has an integral upper wall that rises above the supporting face; and a liner is placed over the upper wall and is connected to the tank shell.

6. A method as recited in claim 1, in which:

the ringbeam has an integral upper wall that rises above the supporting face;

a concrete pourback is poured over the outer end of the dome segments, forming a continuous surface from the top of the upper wall on the ringbeam to a raised portion of the dome segments; and a liner is placed over the continuous surface and is connected to the tank shell.

7. A method as recited in claim 1, in which:

the wedge-shaped dome segments are integrally cast with a steel liner segment on their upper surfaces.

* * * * *